United States Patent [19]

DeKoster et al.

[11] Patent Number: 4,609,897

[45] Date of Patent: Sep. 2, 1986

[54] MINIATURE RELAY

[75] Inventors: Heinz DeKoster, Stamford; Oscar Edelman; Nathan H. Magida, both of Westport, all of Conn.

[73] Assignee: Thermosen, Incorporated, Stamford, Conn.

[21] Appl. No.: 687,014

[22] Filed: Dec. 28, 1984

[51] Int. Cl.[4] ..... H01H 63/02; H01H 67/02

[52] U.S. Cl. ..... 335/133; 335/196; 335/126; 335/229; 335/279; 335/281; 335/255; 335/260

[58] Field of Search ..... 335/131, 133, 196, 255, 335/260, 279, 229, 281, 126

[56] References Cited

U.S. PATENT DOCUMENTS 3,275,775 9/1966 Hawkins ..... 335/126

3,425,008 1/1969 Magida et al. ..... 335/93

4,228,415 10/1980 Schantz ..... 335/255

FOREIGN PATENT DOCUMENTS 2379150 9/1978 France ..... 335/131

*Primary Examiner*—Joseph W. Hartary

*Assistant Examiner*—Lincoln Donovan

*Attorney, Agent, or Firm*—Parmelee, Bollinger & Bramblett

[57] ABSTRACT

A relay is disclosed which is sufficiently miniaturized for use in a DIP socket. It employs tapered switching contacts for obtaining maximum deflection with a given force. Novel adjustable fixed contacts are employed. The solenoid portion is designed to avoid offset adjustment problems and maximize the efficiency of magnetic coupling.

13 Claims, 16 Drawing Figures

Fig. 6.
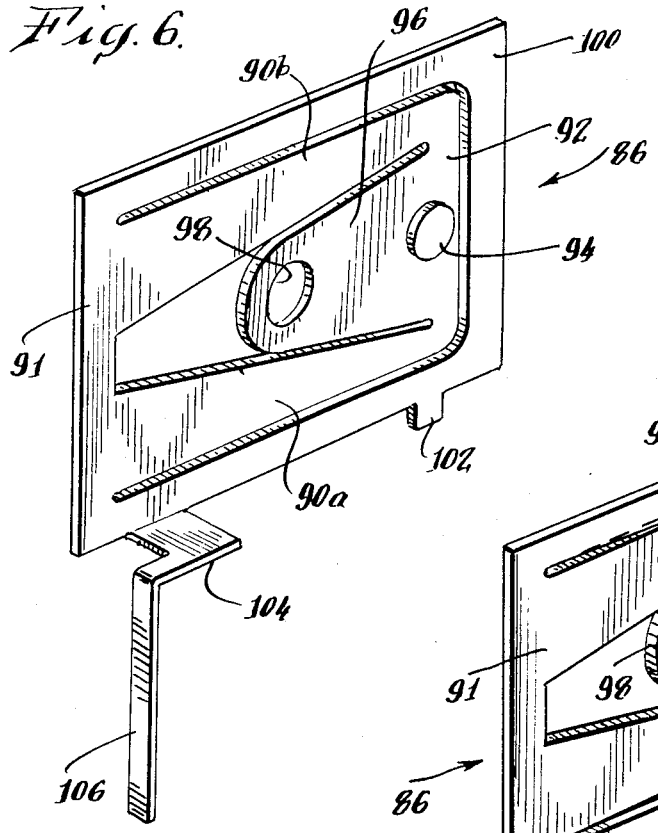
Fig. 7.
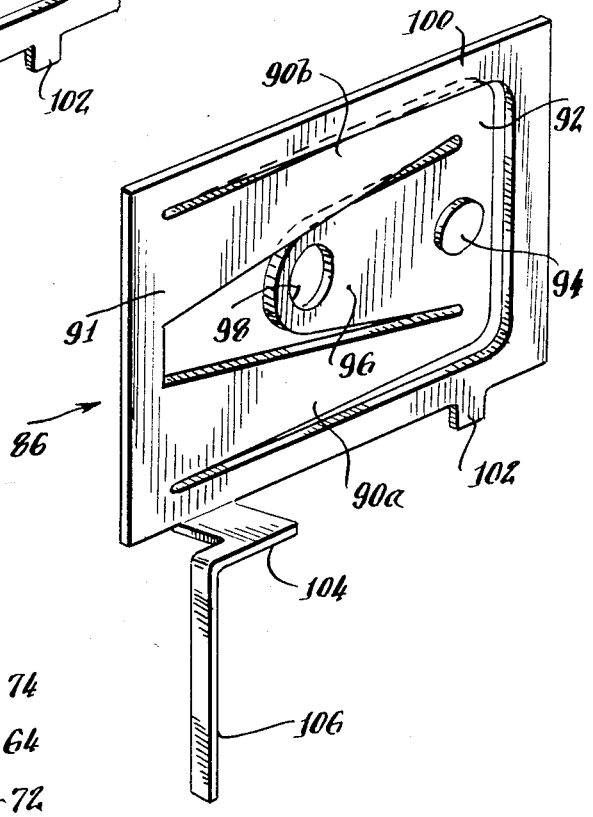
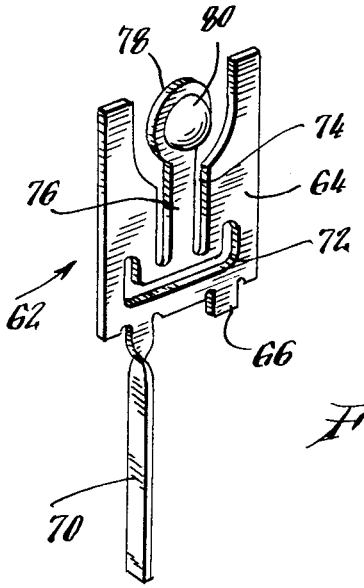
Fig. 8.

Fig. 9A.
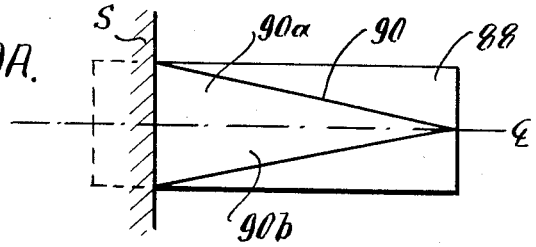
Fig. 9B.
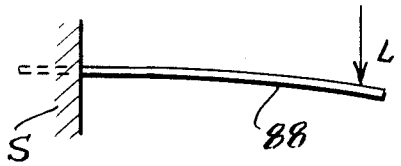
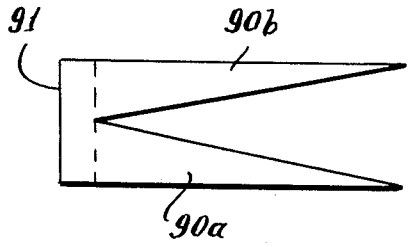
Fig. 10.
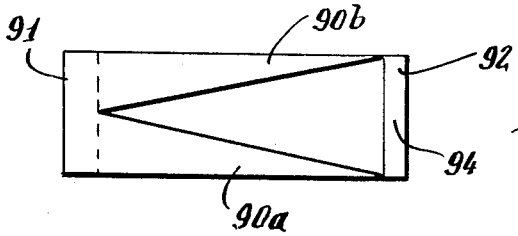
Fig. 11.
Fig. 12.
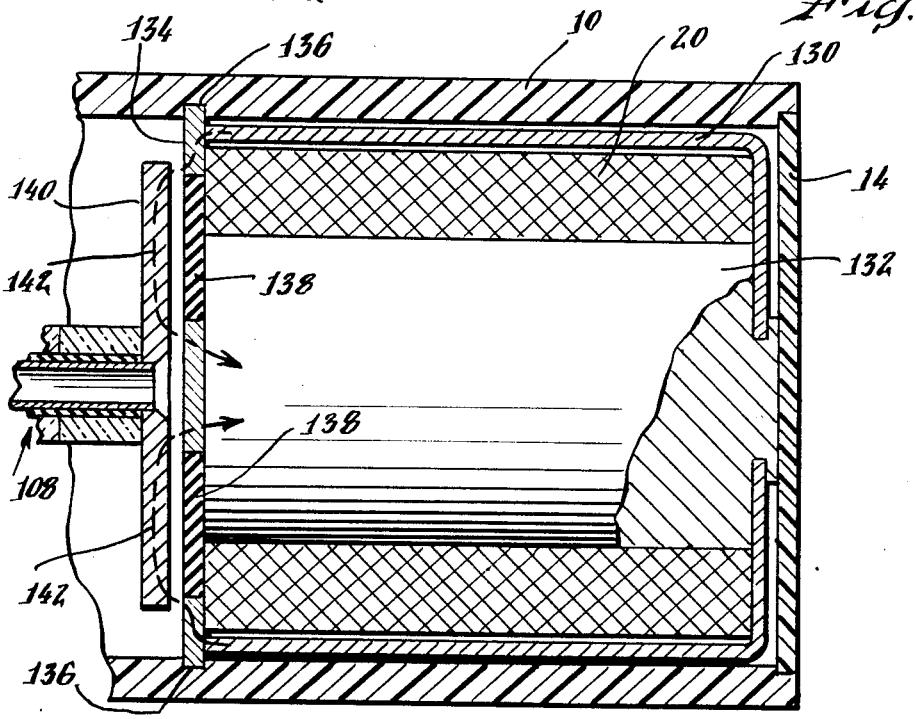

Fig. 13.
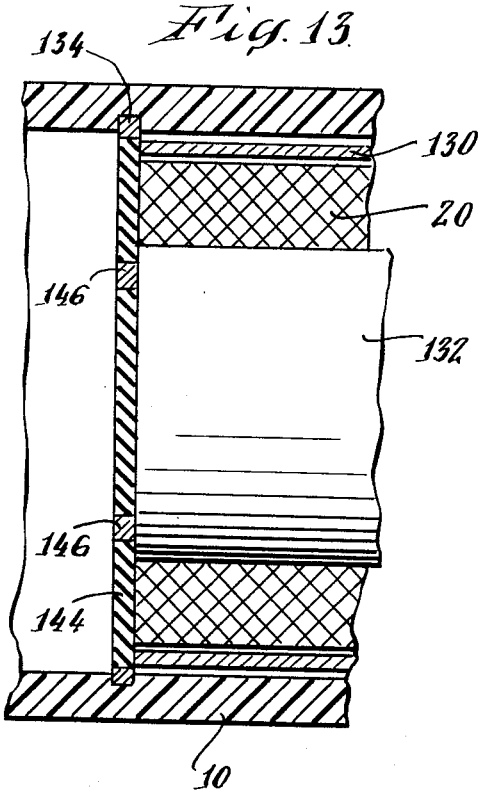
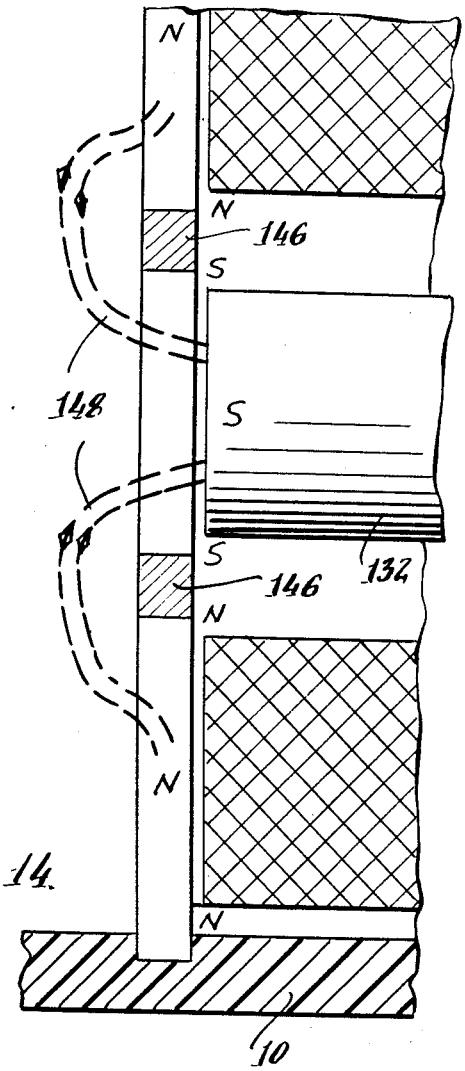
Fig. 14.
Fig. 15.
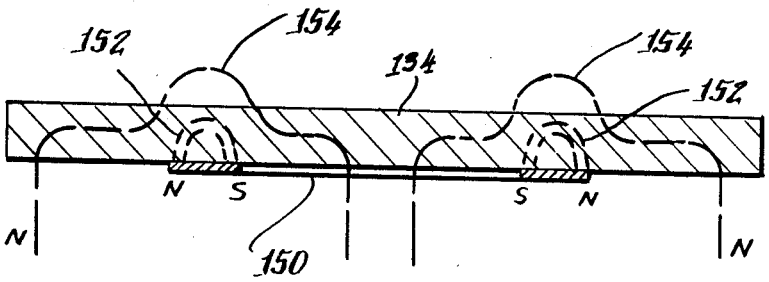

MINIATURE RELAY

TECHNICAL FIELD

The field of this invention is electrical relays and, in particular, relays sufficiently miniaturized to be used with dual inline packaging (DIP) sockets and particularly useful in reliable switching of low level electrical signals.

BACKGROUND ART

The closest art to which this invention pertains is probably that disclosed in U.S. Pat. No. 3,425,008 of Magida et al., assigned to the same assignee as the present invention. However, that device is a reed relay designed to have low electrical noise characteristics. The present invention, on the other hand, pertains to a solenoid operated relay. In such a relay, the electrical contacts are mechanically actuated by a solenoid. Such a construction is particularly desirable when multiple switching contacts are employed. In such circumstances it is important that the various contacts make and break in synchronism. It has been recognized that this result is difficult to attain when using relays. It will also be apparent that many difficulties are encountered when such a device is small enough to be plugged into a conventional DIP socket with external base dimensions approximating that of an integrated circuit—such as 0.770 inch long, 0.400 inch wide, and low enough not to interfere with densely packed circuit elements.

DISCLOSURE OF INVENTION

The invention comprises a relay having a housing with contact pins adapted to engage a standard DIP socket. The housing is rectangular in cross-section and contains a solenoid in one end and defines a contact chamber at the other end. Within the contact chamber are one or more movable and one or more fixed contacts. Each of the movable contacts is in the form of a pair of double triangles bridged at their apexes to support a contact point. They are set in motion by the magnetic action of the solenoid through a linkage extending from the solenoid armature toward the bases of the contact triangles.

BRIEF DESCRIPTION OF DRAWINGS

FIG. 6 is a perspective view of a movable contact in accordance with the invention, in its unstressed condition;

FIG. 7 is a view similar to FIG. 6 showing the contact in its actuated position;

FIG. 8 is a perspective view of a fixed contact in accordance with the invention;

FIGS. 9A and 9B are top and side views, respectively, of a deflected, movable contact under load with a bending moment diagram superimposed thereon;

FIG. 10 illustrates a step in the derivation of the contact of FIG. 6 from the diagram of FIG. 9A;

FIG. 11 illustrates a further step in such derivation;

FIG. 12 is a cross-section, similar to FIG. 2, of a modified solenoid assembly;

FIG. 13 is a fractional illustration showing a modification of the FIG. 12 assembly employing a magnetic barrier;

FIG. 14 is an enlarged illustration of the magnetic barrier of FIG. 13, showing its mode of operation; and FIG. 15 is a cross-section of a modified form of magnetic barrier.

BEST MODE FOR CARRYING OUT THE INVENTION

Figure 1:
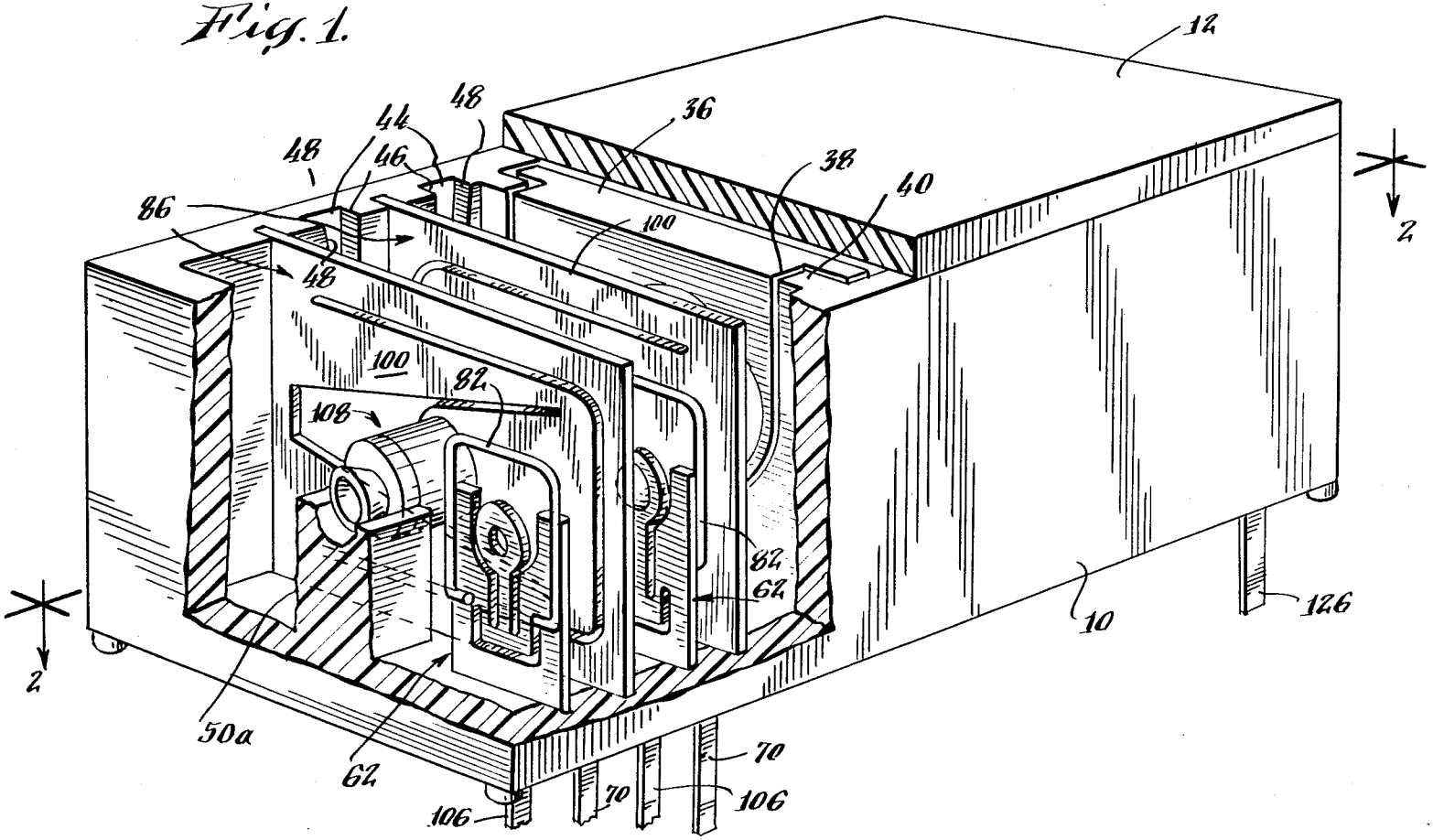
FIG. 1 is a perspective view of a relay constructed in accordance with the invention, portions of the housing being broken away to illustrate its internal construction.

With particular reference to FIGS. 1–5, there is illustrated a relay in accordance with the invention including a box-shaped four-sided housing 10 having a cover 12 and an end cap 14. The external dimensions of the assembled housing, while not constituting an element of the invention, may be similar to those mentioned above under "Background Art". The right hand end of housing 10, as viewed in FIGS. 1–3, houses a solenoid assembly 16 while the left end defines a contact chamber 18.

Solenoid Assembly

Figure 2:
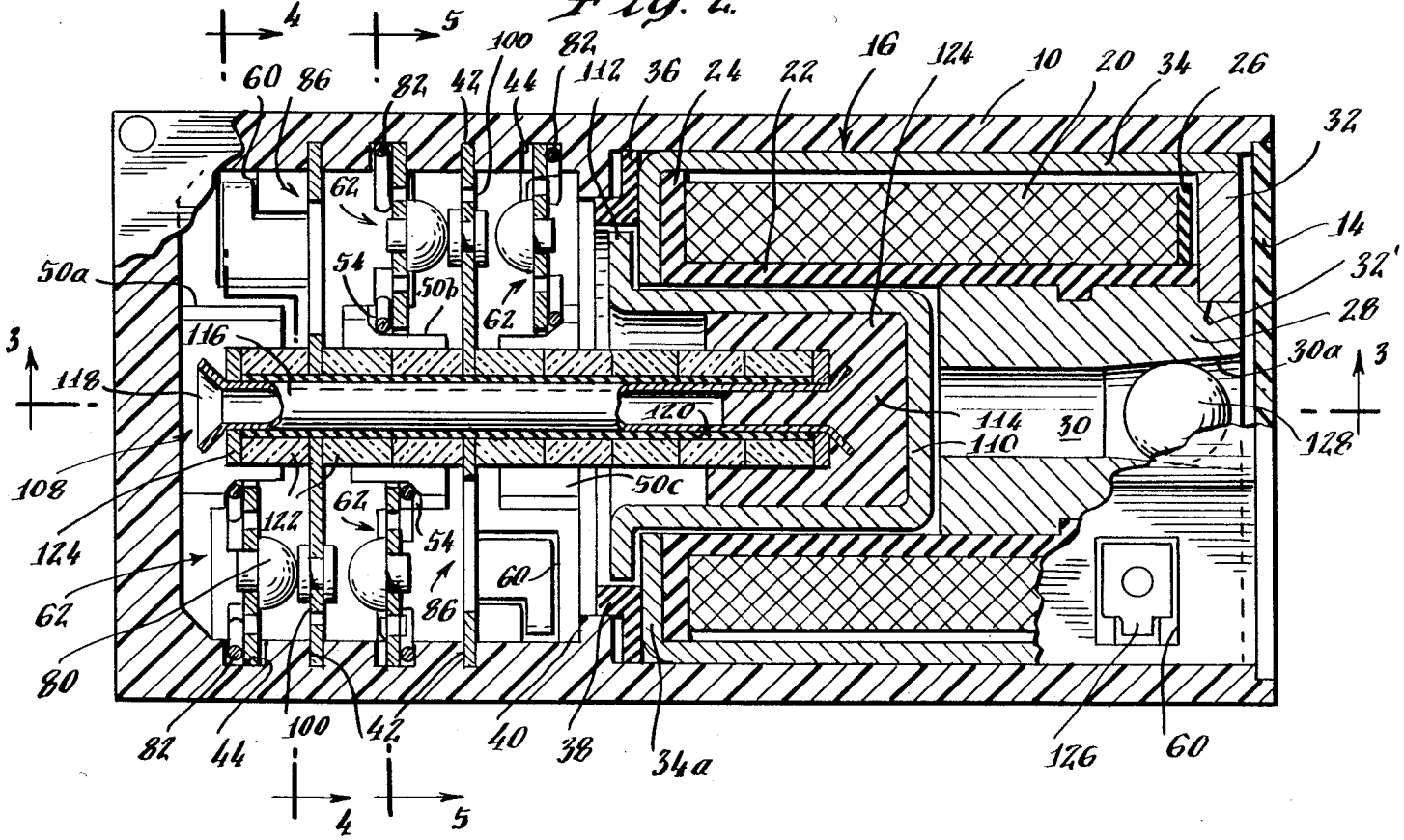
FIG. 2 is a cross-sectional plan view taken substantially along the plane 2—2 of FIG. 1.
Figure 3:
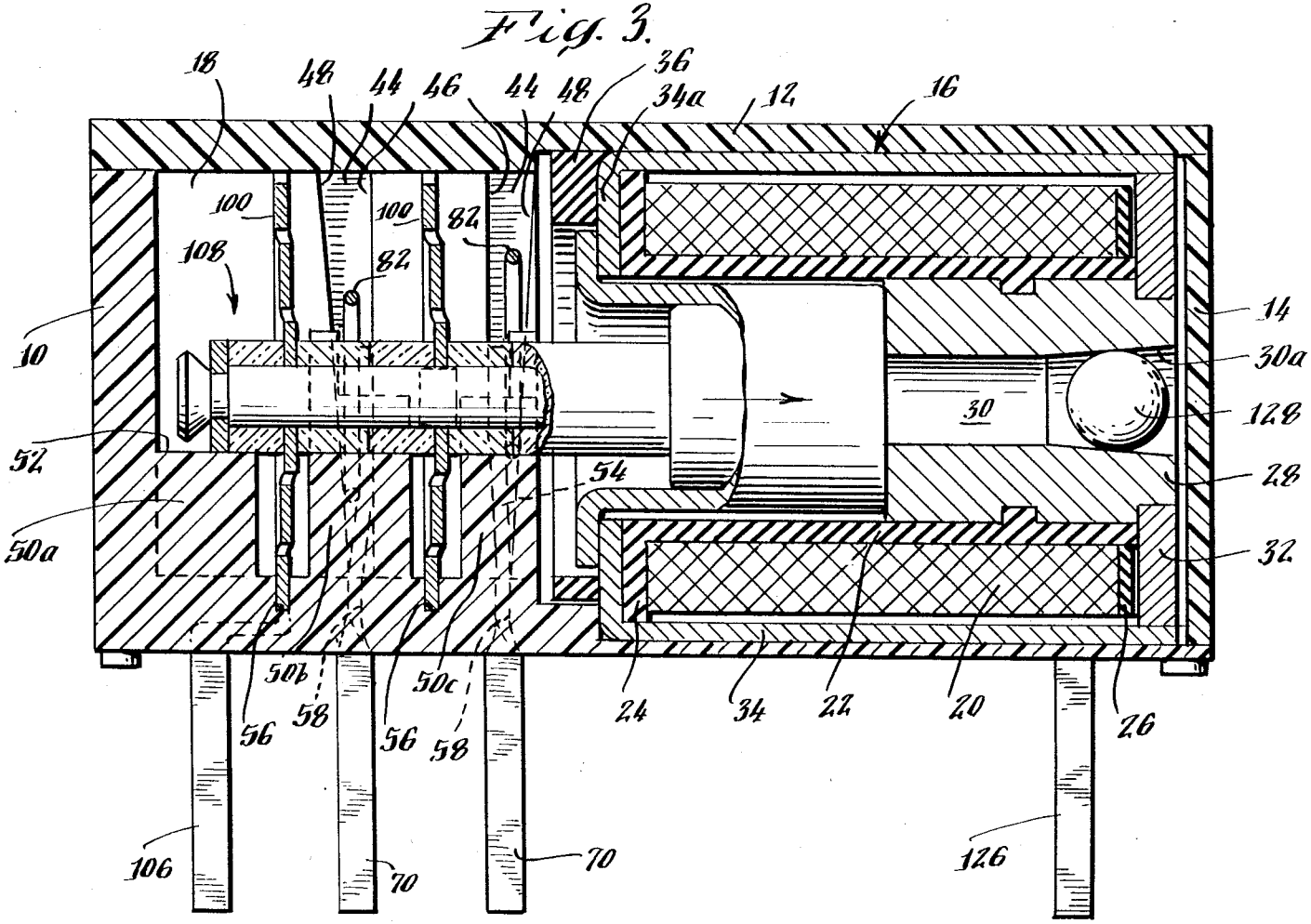
FIG. 3 is a cross-section taken substantially along the line 3—3 of FIG. 2.
Figure 4:
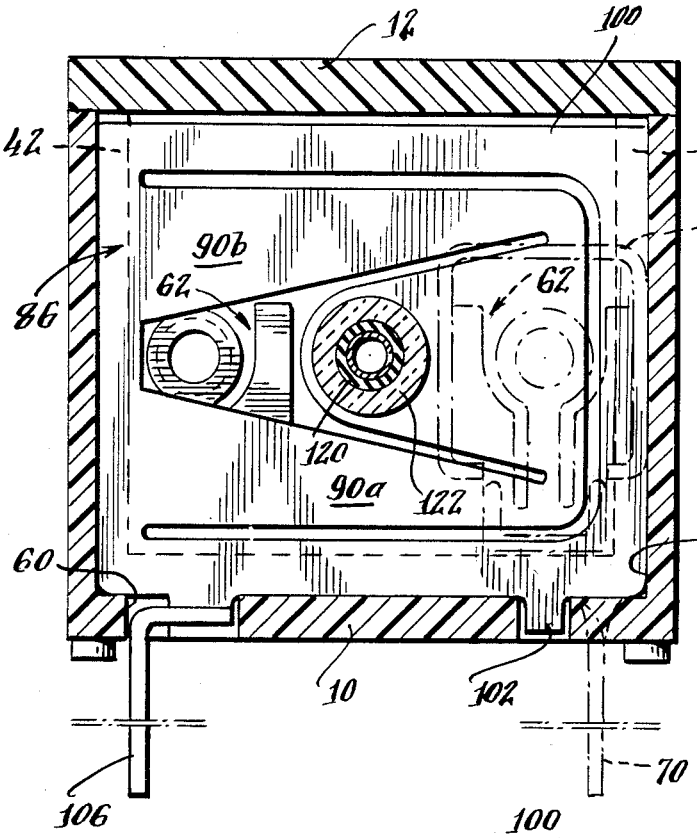
FIG. 4 is a cross-section taken substantially along the line 4—4 of FIG. 2.

Solenoid assembly 16 comprises a self-supporting solenoid coil 20 mounted on a cylindrical plastic spool 22 having an end flange 24 abutting one end of coil 20. The opposite end of coil 20 is retained by an insulating washer 26. The solenoid assembly 16 includes a magnetic return path assembly which includes a cylindrical magnetic plug 28 extending approximately halfway through the spool 22 as seen in FIGS. 2 and 3. The plug 28 defines a central passage 30 including a partially conical portion 30*a*. A square magnetic rear plate 32 has a circular central opening 32' for receiving the end of the cylindrical plug 28. A U-shaped strap 34 of magnetic material is positioned in the housing 10 with its legs against the right and left sides of the housing and in engagement with the sides of the rear plate 32. The base 34*a* of the strap 34 has a circular central opening aligned with the open center of spool 22. A plastic closure plate 36 completes solenoid assembly 16. It has a rectangular periphery and a U-shaped flange 38 which engages retaining wall 40 and the interior walls of housing 10 and a flat top which engages the cover 12.

Contact Chamber

The sidewalls of housing 10 which enclose the contact chamber 18, define vertical slots 42 alternating with adjustment slots 44. As will be clear from FIG. 3, each of the adjustment slots 44 is defined by a vertical edge wall 46 and an angled edge wall 48, the adjustment slots 44 in each sidewall being symmetrical but in reversed relationship.

Extending upwardly from the bottom of the housing 10 and in alignment with its longitudinal center line are three blocks 50*a*, 50*b*, 50*c*. The upper surfaces of the blocks define concave cylindrical surfaces 52, which are coaxial with one another and with coil spool 22. Those surfaces of blocks 50*a, b, c*, which face the adjustment slots 44 in the sidwalls of the housing 10, carry angled shoulders 54, each of which is aligned with the angled edge wall 48 of a corresponding adjustment slot 44.

The bottom wall of the housing 10 defines slots 56 (FIG. 3) which extend between opposed vertical slots 42. It also defines shorter slots 58 which extend between each of the adjustment slots 44 and a corresponding block 50*a, b*, or *c*. In addition to the slots in the bottom wall of the housing 10, various other openings 60 are provided to permit electrical connections to external pins as will be explained.

Fixed Contacts

Figure 5:
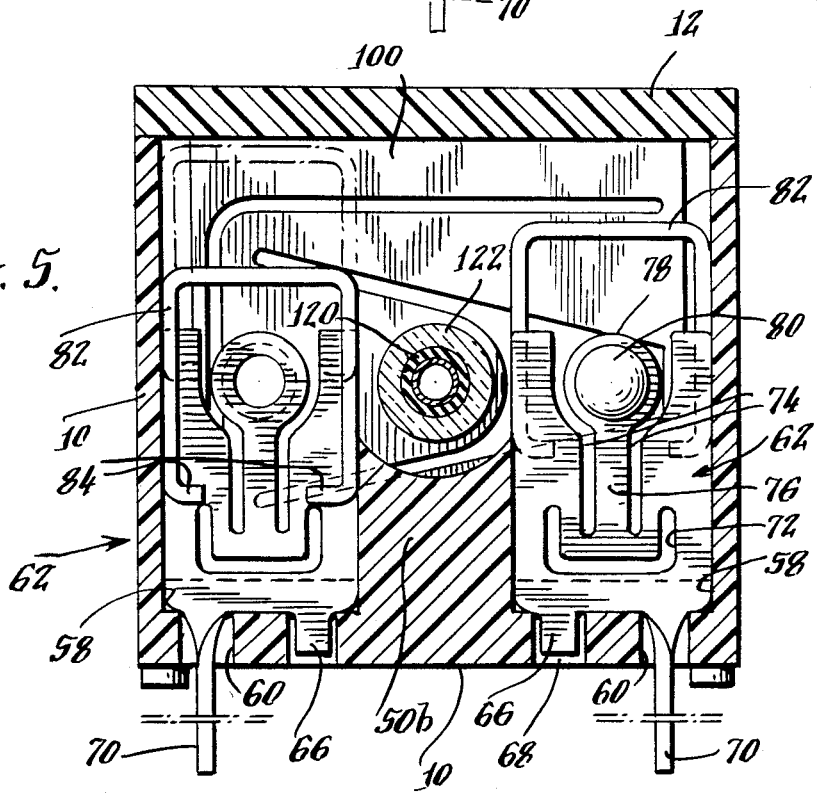
FIG. 5 is a cross-section taken substantially along the line 5—5 of FIG. 2.

Inserted into each of the slots 58 is the base of a fixed contact structure 62. Contact structures 62 are basically planar and formed of, for example, 0.010 inch thick copper. Each is positioned with one edge in an adjustment slot 44 and the other edge adjacent one of the angled shoulders 54. Fixed contact structures 62 are identical but reversed and one is illustrated in detail in FIG. 8. As indicated, it is fabricated, as by etching, stamping or other means, from a thin metal sheet such as copper. It comprises a substantially rectangular outer frame 64, the lower edge of which is embedded in a slot 58 (FIG. 5). Extending downwardly from its lower edge is a short stabilizing tab 66 positioned in a keyway 68 formed in housing 10 and a longer appendage which extends downwardly through one of the openings 60 and is twisted 90° to form one of the pin contacts 70 of the assembled relay.

A U-shaped cutout 72 is located slightly above the top of the slot 58. Slot 58 secures the bottom of contact structure 62. The upwardly extending arms of cutout 72 enclose the lower ends of a pair of vertical cutouts 74 which extend downwardly from the top of the contact structure 62 to thereby isolate what is, in effect, a cantilevered contact spring 76. The vertical cutouts 74 diverge at the top of the contact structure 62 to permit the upper end of contact spring 76 to terminate in an enlarged head 78, upon which is mounted a gold contact button 80. Button 80 may be on either side of head 78 as required by its ultimate position, as shown in FIG. 2.

The fixed contact structures are factory adjustable by means of a wire formed into a U-shaped adjustment device 82 having a pair of short spaced legs 84. Device 82 is inserted so that legs 84 are located between the outer frame 64 of the contact structure 62 and the corresponding angled edgewall 48 of its adjustment slot 44 and the angled shoulder 54 of the corresponding block 50. The function of the adjustment clips will be further described below.

Movable Contacts

Mounted between the side slots 42 and retained within the lower slots 56 are movable contact structures 86. The contact structure 86 has a unique shape whose derivation can be best understood by the following discussion taken in connection with FIGS. 9–11.

Basically, the movable contact employed with this invention is an elastic piece of sheet metal such as a leaf spring. Because of the small size and low power requirements of the miniaturized relay of the invention, it is desirable to maximize the deflection of the contact with a given force. FIGS. 9A and 9B illustrate the top and side views, respectively, of a cantilevered leaf spring 88 mounted in a support S at one end and having a load L at its other. The distribution of the bending moment under these conditions is shown by the triangular diagram 90 superimposed on spring 88. Thus, the ideal shape of a spring to obtain maximum deflection from a given force while keeping the stress within safe limits is such a triangle.

There is a problem in how to apply the force that moves such a triangle while still retaining physical space for an electrical contact. Conceptually, this is done by separating the triangle of diagram 90 into two separate triangles **90*a*, 90*b* on either side of the centerline of the spring of FIG. 9A. The resulting sub-triangles are then repositioned as shown in FIG. 10. The two sub-triangles 90*a*, 90*b* are joined at their bases by a support strip 91. In order to provide an electrical contact at the proper location, the apexes of the two sub-triangles are joined by a bridge member 92 carrying a contact button 94** at its center.

Turning now to FIG. 6, it will be seen how the conceptual arrangement derived in FIGS. 9–11 was incorporated into an actual structure—namely, the movable contact structure 86. This structure, similar to fixed contact structure 62, may be fabricated by any means such as stamping, etc., from a sheet of conductive material such as pure copper of 0.010 inch thickness. In order to physically move the contact button 94 from a centrally operated solenoid, there is provided a re-entrant link 96 which extends away from the contact button 94 into the space between the two sub-triangles **90*a*, 90*b* and defines a hole 98 for engagement with the solenoid. The structure so far described is formed with an external rectangular frame 100 which is integral with the support strip 91 but is otherwise independent of the movable portion of the structure. The lower margin of the frame 100, as shown in FIG. 6, includes a short depending tab 102 and a longer L-shaped tab 104 which is bent into the position shown to form an elongated contact pin 106**.

Pull-Rod Assembly

The movable contacts of the relay of this invention are operated by a solenoid. Most prior art relays employ either a "clapper" mechanism or a relatively elongated core which extends through the major length of the solenoid winding. In both instances there are offset adjustment problems caused—in the first instance, by the off-axis movement of the clapper and, in the second, by the relatively large passive air gap as compared with the active air gap. In accordance with the present invention, there is provided a plunger assembly 108 which substantially overcomes these problems.

Referring to FIG. 2, the plunger assembly 108 will be seen to comprise a magnetic cup 110 of a shape and size to fit within the spool 22 with its bottom closely adjacent the plug 28 and approximately at the center of coil 20. The lip of the cup 110 forms an annular flange 112 which overlies the base **34*a* of strap 34. A pull rod has one end anchored in cup 110 as, for example, by means of an epoxy 114. The pull rod comprises an inner metal tube 116 flared at its ends 118 to hold an insulating sleeve 120 and a plurality of glass beads 122 which retain therebetween the links 96 of the moving contacts and are, in turn, retained by end washers 124**.

Electrical connections to the solenoid coil 20 are provided by a pair of contact pins 126 which extend through the base of the housing 10. In a final manufacturing step, the interior of the contact chamber of housing 10 is evacuated and refilled with an inert gas, such as nitrogen, through the passage 30 which is thereafter sealed with a plug 128 which is epoxyed or otherwise secured in place.

Solenoid Modifications

In a precision miniature relay of the type disclosed herein, it is important to use the design approach which yields the best combination of specifications of coil power, contact travel, and contact forces. Accordingly, there are disclosed herein certain modified solenoid designs.

The first modification is illustrated in FIG. 12. In this modification, the plunger actuator previously described is omitted and is replaced by a plate. In this modification, the coil 20 is positioned within a magnetizable cup 130 within which is mounted a magnetizable central pole 132. This assembly is retained within the housing 10 by a barrier plate 134 retained by slots 136 in the housing 10. The plate 134 is a composite structure fabricated basically of a magnetizable material such as iron. However, it has a non-magnetizable ring barrier 138 circling the axis of the solenoid assembly. The plunger assembly 108 terminates at an actuator plate 140.

The presence of the ring barrier 138 causes the magnetic flux to be diverted, as illustrated by the flux lines 142, thereby improving the magnetic coupling between solenoid and plate 140.

A further modification of the FIG. 12 approach is illustrated in FIG. 13. In this modification, the plate 134 has relatively large regions of ferro-magnetic material 144 but includes a permanently magnetized thin ring barrier 146. The functioning of ring barrier 146 is schematically illustrated in FIG. 14. The ring 146 is magnetized so that its inner diameter forms one magnetic pole and its outer diameter, the other. It is positioned such that these poles are adjacent similarly polarized regions of the solenoid. Thus, if the pole 132 of the solenoid is a south pole, as illustrated in FIG. 14, the inner diameter of the ring barrier 146 is also a south pole. Thus, the poles repel one another and the lines of magnetic flux 148, forcing the flux to "detour" into the region of the actuator plate.

A further modification is illustrated in FIG. 15 wherein the plate 134 is of soft steel that has cemented thereto a thin, hardened steel ring 150. The steel ring 150 is magnetized in the same fashion as ring barrier 146 so that its lines of flux 152 extend through the plate 134 as illustrated in FIG. 15. They thereby repel the flux lines 154 produced by the solenoid winding into the region of the actuator plate 140.

These modified approaches maximize the working air gap area while minimizing the flux leakage that occurs across the air gap.

Assembly and Operation

The assembly and operation will now be described with reference to the relay modification illustrated in FIGS. 1–8. The pulling bar portion of plunger assembly 108, including the glass beads 122, is pre-assembled to the moving contacts 86 in a fixture designed for that purpose. The stationary contacts 62 are inserted into the housing 10 where they are kept in position by friction. The solenoid assembly 16, together with the plunger cup 110, is assembled as a unit. An external magnetic field is generated which causes the flange 112 of the cup 110 to be positioned against the coil assembly.

Epoxy is then applied to all slots in the housing 10. The pulling bar assembly and movable contacts are then inserted into the housing and held in place by friction. In this configuration, the pulling bar finds its zero position. Epoxy is next applied to the inside of the plunger cup 110 and the solenoid sub-assembly 16 is inserted into the housing 10 and pushed forward until it hits the edge of the partition 36. The relay is next put into a curing oven and after the epoxy curing cycle is complete, all contacts are fixed to the housing, the plunger is attached to the pulling bar, and the plunger is properly centered inside the solenoid winding assembly. The magnetic force that held the plunger relative to the winding assembly is now removed.

Next, the normally closed contacts are adjusted. The adjustment devices 82 are slowly pushed down, thereby forcing their associated fixed contacts 62 into positions where they barely touch their associated movable contacts. Once this condition has been reached, each device is further pushed down another 0.005 inch.

The solenoid is once more magnetized to retract the plunger. The solenoid winding assembly may then be moved by means of a micrometer screw to adjust the spacing between the fixed and movable contacts to specifications. The normally open fixed contacts are then adjusted in the same fashion utilizing the adjustment devices 82. Finally, the magnetic air gap is adjusted and the solenoid winding assembly 16 is bonded into place by a quick bonding glue.

It is believed that the operation of this relay will be obvious. The basic principle is simple. Energization of the solenoid retracts the plunger assembly and pull rod, pulling the link 96 of each of the adjustable contact structures 86, thereby deflecting the contact button 94 into engagement or out of engagement with the contact button 80 on one of the fixed contacts 62. However, due to the novel features described above, it has been possible to achieve a number of important objectives. For example, it has become possible to adjust the fixed contacts of a very small relay unit while maintaining the spring rate of the unit constant.

It is often difficult to synchronize the switching action of two independent contacts in a small unit. In this unit, however, there is employed a solid pulling rod which is extra firm and is mechanically rigidly connected to the two moving contacts. This leads to synchronous operation and also eliminates any wear points.

The novel design of the moving contacts of the invention has made it possible to obtain greater deflection with a given force while keeping the stresses on the moving contacts within safe limits. Another advantage of the movable contact design is that it becomes possible to use materials, such as copper, which are good conductors, rather than spring materials. This results in improved resistance characteristics. By proper choice of the materials used in the contact spring system including the movable contacts, the fixed contacts, and the contact buttons, other major performance advantages may be achieved including:

1. low thermal e.m.f.;
2. low, stable, contact resistance; and
3. excellent high frequency transmission characteristics.

It is believed that many other advantages of the present invention will also be apparent to those skilled in the art. It will also be apparent that a number of variations and modifications may be made in this invention without departing from its spirit and scope. Accordingly, the foregoing description is to be construed as illustrative only, rather than limiting. This invention is limited only by the scope of the following claims.

What is claimed is:

1. A miniaturized electrical relay having high speed switching characteristics at low power comprising:

a housing;

a solenoid enclosed by said housing;

actuating means within said housing longitudinally movable by said solenoid along a first axis between a first and a second position;

a unitary electrically conductive rectangle substantially fixedly mounted in said housing by two opposed edges;

a substantially U-shaped slot piercing said rectangle, the open end of the U being adjacent one of the opposed edges and the base of the U being adjacent the other of the opposed edges, to thereby form an external fixed frame and a yieldable inner member having a base end fixed to said frame and a free distal end;

a substantially V-shaped opening piercing said inner member, the apex of the V being in its base end and the arms of the V terminating in its distal end;

an electrical switching contact carried by said distal end;

a reentrant link extending inwardly of the V from said distal end for connection to said actuating means; and a fixed contact member retained in said housing and positioned for engagement with said switching contact upon actuation of said inner member to one of its first and second switching positions.

2. The relay of claim 1 wherein said actuating means is a pull rod.

3. A miniaturized electrical relay having high speed switching characteristics at low power comprising:

a housing;

a solenoid enclosed by said housing;

actuating means within said housing longitudinally movable by said solenoid along a first axis between a first and a second position;

a bendable planar contact member secured in said housing substantially perpendicular to said first axis and tapered from a fixed base end to a relatively smaller distal end carrying an electrical switching contact;

linkage means for actuating the distal end of said bendable contact member between first and second switching positions from movement of said actuating means between its first and second positions;

a unitary, planar, substantially U-shaped body member fixed in said housing along its base, the arms of the U being adjustably fixed in the housing;

a pair of inwardly depending legs extending from, and integral with, the arms of the U;

a vertical contact spring extending upwardly between, and integral with, said legs; and an electrical contact mounted on said vertical contact spring.

4. The relay of claim 3 wherein:

said housing defines opposed, tapered slots receiving the arms of the U-shaped body member; and means for adjusting the position of each arm in its slot is slidably positionable between the arm and its respective slot wall.

5. The relay of claim 4 wherein the adjusting means comprises a substantially U-shaped clip having a different leg in each of the opposed tapered slots.

6. A miniaturized electrical relay having high speed switching characteristics at low power comprising:

a housing;

a substantially hollow cylindrical winding having a first end and a second end;

a magnetically permeable core extending substantially through said winding from its first to its second end;

a magnetically permeable path extending along the outer surface of said winding from the core at the first end to the second end to form a magnetically permeable ring around the second end of said winding;

an annular magnetic barrier adjacent said permeable ring and encircling said core;

a magnetically permeable plate connected to said actuating means and positioned to be drawn toward said core by magnetic flux bypassing said barrier between said ring and core upon energization of said winding;

actuating means within said housing longitudinally movable by said plate along a first axis between a first and a second position;

a bendable planar contact member secured in said housing substantially perpendicular to said first axis and tapered from a fixed base end to a relatively smaller distal end carrying an electrical switching contact;

linkage means for actuating the distal end of said bendable contact member between first and second switching positions from movement of said actuating means between its first and second positions; and a fixed contact member retained in said housing and positioned for engagement with said switching contact upon actuation of said bendable contact member to one of its first and second switching positions.

7. The relay of claim 6 wherein said magnetic barrier comprises:

a magnetized ring wherein the outer periphery is one magnetic pole and the inner periphery is the other magnetic pole, said poles being placed in juxtaposition to poles of like polarity produced by said winding.

8. The relay of claim 6 wherein said permeable ring is a peripheral region of a substantially homogeneous plate and said magnetic barrier is a magnetized annulus on the surface of said plate having its outer periphery forming one magnetic pole and its inner periphery forming the other magnetic pole, said poles being placed in juxtaposition to poles of like polarity produced by said winding.

9. The relay of claim 6 wherein said magnetic barrier comprises a magnetically non-permeable ring.

10. A solenoid which comprises:

a substantially hollow cylindrical winding having a first and a second end;

a magnetically permeable core extending substantially through said winding from its first to its second end;

a magnetically permeable path extending along the outer surface of said winding from the core at the first end to the second end to form a magnetically permeable ring around the second end of said winding;

an annular magnetic barrier adjacent said permeable ring and encircling said core; and a magnetically permeable actuator positioned to be drawn toward said core by magnetic flux bypassing said barrier between said ring and core upon energization of said winding.

11. The solenoid of claim 10 wherein said magnetic barrier comprises:

a magnetized ring wherein the outer periphery is one magnetic pole and the inner periphery is the other magnetic pole, said poles being placed in juxtaposition to poles of like polarity produced by said winding.

12. The solenoid of claim 10 wherein said permeable ring is a peripheral region of a substantially homogeneous plate and said magnetic barrier is a magnetized annulus on the surface of said plate having its outer periphery forming one magnetic pole and its inner periphery forming the other magnetic pole, said poles being placed in juxtaposition to poles of like polarity produced by said winding.

13. The solenoid of claim 10 wherein said magnetic barrier comprises a magnetically non-permeable ring.

* * * * *